US006439179B2

(12) United States Patent
Hendriksma et al.

(10) Patent No.: US 6,439,179 B2
(45) **Date of Patent: *Aug. 27, 2002**

(54) DEACTIVATION AND TWO-STEP ROLLER FINGER FOLLOWER HAVING A BRACKET AND LOST MOTION SPRING

(75) Inventors: Nick J. Hendriksma, SE. Grand Rapids, MI (US); Jongmin Lee, Pittsford, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/881,622

(22) Filed: Jun. 14, 2001

Related U.S. Application Data

(63) Continuation-in-part of application No. 09/664,668, filed on Sep. 19, 2000.

(60) Provisional application No. 60/176,133, filed on Jan. 14, 2000.

(51) Int. Cl.[7] ..... F01L 13/00; F02D 13/00

(52) U.S. Cl. ..... 123/90.16; 123/90.42; 123/198 F

(58) Field of Search ..... 123/90.15, 90.16, 123/90.39, 90.41, 90.42, 90.43, 90.44, 198 F

(56) References Cited

U.S. PATENT DOCUMENTS

| | | | | | |
|---|---|---|---|---|---|
| 4,768,467 | A | * | 9/1988 | Yamada et al. | 123/90.16 |
| 5,544,626 | A | * | 8/1996 | Diggs et al. | 123/90.16 |
| 5,655,488 | A | * | 8/1997 | Hampton et al. | 123/90.16 |
| 6,058,895 | A | * | 5/2000 | Hermsen | 123/90.16 |
| 6,186,101 | B1 | * | 2/2001 | Kreuter | 123/90.15 |
| 6,321,705 | B1 | * | 11/2001 | Fernandez et al. | 123/90.16 |
| 6,325,030 | B1 | * | 12/2001 | Spath et al. | 123/90.16 |

* cited by examiner

*Primary Examiner*—Weilun Lo
(74) *Attorney, Agent, or Firm*—John Van Ophem

(57) ABSTRACT

A roller finger follower includes an elongate body having a first side member and a second side member. A bracket having first and second sides is associated with the body. The first side of the bracket is disposed adjacent an inside surface of the first side member of the body. The second side of the bracket is disposed adjacent an inside surface of the second side member of the body. A roller is disposed between the first and second sides of the bracket. The roller defines a shaft orifice therethrough. An elongate hollow shaft extends through the shaft orifice and couples the roller to the bracket. A locking pin assembly is disposed at least partially within the hollow shaft. The locking pin assembly has a first position wherein the shaft is decoupled from the body and a second position wherein the shaft is coupled to the body. The locking pin assembly is switchable between the first and second positions.

19 Claims, 5 Drawing Sheets

DEACTIVATION AND TWO-STEP ROLLER FINGER FOLLOWER HAVING A BRACKET AND LOST MOTION SPRING

CROSS REFERENCE TO RELATED APPLICATIONS

This application is a continuation-in-part of U.S. patent application Ser. No. 09/664,668, filed Sep. 19, 2000, entitled Roller Finger Follower for Valve Deactivation, which claims the benefit of U.S. Provisional Patent Application Ser. No. 60/176,133, filed Jan. 14, 2000.

TECHNICAL FIELD

The present invention generally relates to cylinder and/or valve deactivation and two-step variable valve lift systems in internal combustion engines. More particularly, the present invention relates to a roller finger follower rocker arm device that accomplishes valve deactivation and/or cam profile mode switching in internal combustion engines.

BACKGROUND OF THE INVENTION

Deactivation roller finger followers (RFFs) typically include a body and a roller carried by a shaft. The roller is engaged by a cam of an engine camshaft that causes the RFF body to pivot, thereby actuating an associated engine valve. The deactivation RFF is selectively switched between a coupled and a decoupled state. In the coupled state the shaft is coupled to the body, and rotation of the output cam is transferred from the roller through the shaft to pivotal movement of the RFF body, which, in turn, reciprocates the associated valve. In the decoupled state, the shaft is decoupled from the body. Thus, the shaft does not transfer rotation of the output cam to pivotal movement of the RFF body, and the associated valve is not reciprocated. Rather, the shaft is reciprocated within grooves formed in the RFF body. The grooves retain and guide the reciprocation of the shaft.

A two-step RFF operates in a manner similar to a deactivation RFF, as described above. However, one particular difference between the operation of a deactivation RFF and a two-step RFF occurs in the decoupled mode of operation. The body of a deactivation RFF is typically engaged by zero-lift cam lobes. In the decoupled mode, the zero-lift cam lobes simply maintain the deactivation RFF body in a static position. Thus, the associated engine valve is not reciprocated. The body of a two-step RFF is engaged by associated low-lift cam lobes. In the decoupled mode, the body of the two-step RFF is pivoted by the low-lift cam lobes. The pivoting of the body of the two-step RFF in the decoupled mode, in turn, reciprocates the associated engine valve according to the lift profile of the low-lift cam lobe.

Lost motion springs maintain contact between the roller and the output cam when either type (i.e., deactivation or two-step) of RFF is in the decoupled mode. The lost motion springs engage the shaft and the body of the RFF. The springs bias the shaft and roller against the output cam, and absorb the reciprocal motion of the shaft and roller. However, lost motion springs add undesirable width to conventional RFF's. Furthermore, movement of the lost motion springs causes wear and friction where the springs contact the body of the roller finger follower. Even further, the side load capacity of conventional RFF's may not be suitable for some applications. Moreover, as the shaft reciprocates within the grooves, movement, or play, of the shaft within the grooves in a direction generally transverse to the body may result in binding of the shaft and/or misalignment of the locking pin assembly, thereby making it difficult to re-couple the shaft to the body.

Therefore, what is needed in the art is an RFF having a reduced width for use in applications with limited space.

Furthermore, what is needed in the art is an RFF that reduces friction and wear through sliding contact between the lost motion springs and the body.

Even further, what is needed in the art is an RFF having increased side load capacity.

Even further, what is needed in the art is an RFF that reduces play of the shaft in a direction transverse to the grooves and/or body.

Still further, what is needed in the art is an RFF that reduces the potential for locking pin assembly misalignment, thereby improving the reliability of mode switching in the RFF.

Moreover, what is needed in the art is an RFF that reduces the likelihood of the shaft binding within the grooves, thereby improving the reliability of mode switching in the RFF.

SUMMARY OF THE INVENTION

The present invention provides a deactivation and/or two-step roller finger follower for use with an internal combustion engine.

The invention comprises, in one form thereof, an elongate body having a first side member and a second side member. A bracket having first and second sides is associated with the body. The first side of the bracket is disposed adjacent an inside surface of the first side member of the body. The second side of the bracket is disposed adjacent an inside surface of the second side member of the body. A roller is disposed between the first and second sides of the bracket. The roller defines a shaft orifice therethrough. An elongate hollow shaft extends through the shaft orifice and couples the roller to the bracket. A locking pin assembly is disposed at least partially within the hollow shaft. The locking pin assembly has a first position wherein the shaft is decoupled from the body and a second position wherein the shaft is coupled to the body. The locking pin assembly is switchable between the first and second positions.

An advantage of the present invention is that the RFF has a reduced width for use in applications with limited space.

Another advantage of the present invention is that the RFF eliminates the need for washers to retain the needle bearing needles.

Still another advantage of the present invention is that RFF reduces friction and wear through sliding contact between the lost motion springs and the RFF body.

Yet another advantage of the present invention is that the RFF has increased side load capacity.

A further advantage of the present invention is a reduction of play of the shaft in a direction transverse to the grooves/body of the RFF, and thus increased reliability in mode switching of the RFF.

An even further advantage of the present invention is a roller finger follower with a reduced likelihood of locking pin misalignment, and thus increased reliability in mode switching of the RFF.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplifications set out herein illustrate the preferred embodiments of the invention and such exemplifications are not to be construed as limiting the scope of the invention in any manner.

DESCRIPTION OF THE PREFERRED EMBODIMENTS

Generally, and as will be described more particularly hereinafter, the roller finger follower of the present invention includes a lost motion bracket and lost motion springs. The bracket is coupled to a hollow shaft, and coil springs connect the bracket to the body of the roller finger follower. In the default or coupled state, the roller finger follower assembly operates as a conventional roller finger follower. In the decoupled state, the bracket and coil springs replace the lost motion springs of conventional two-step and deactivation roller finger followers. The bracket and coil springs maintain contact between the roller and the cam when the roller is decoupled from the body of the roller finger follower.

Figure 1:
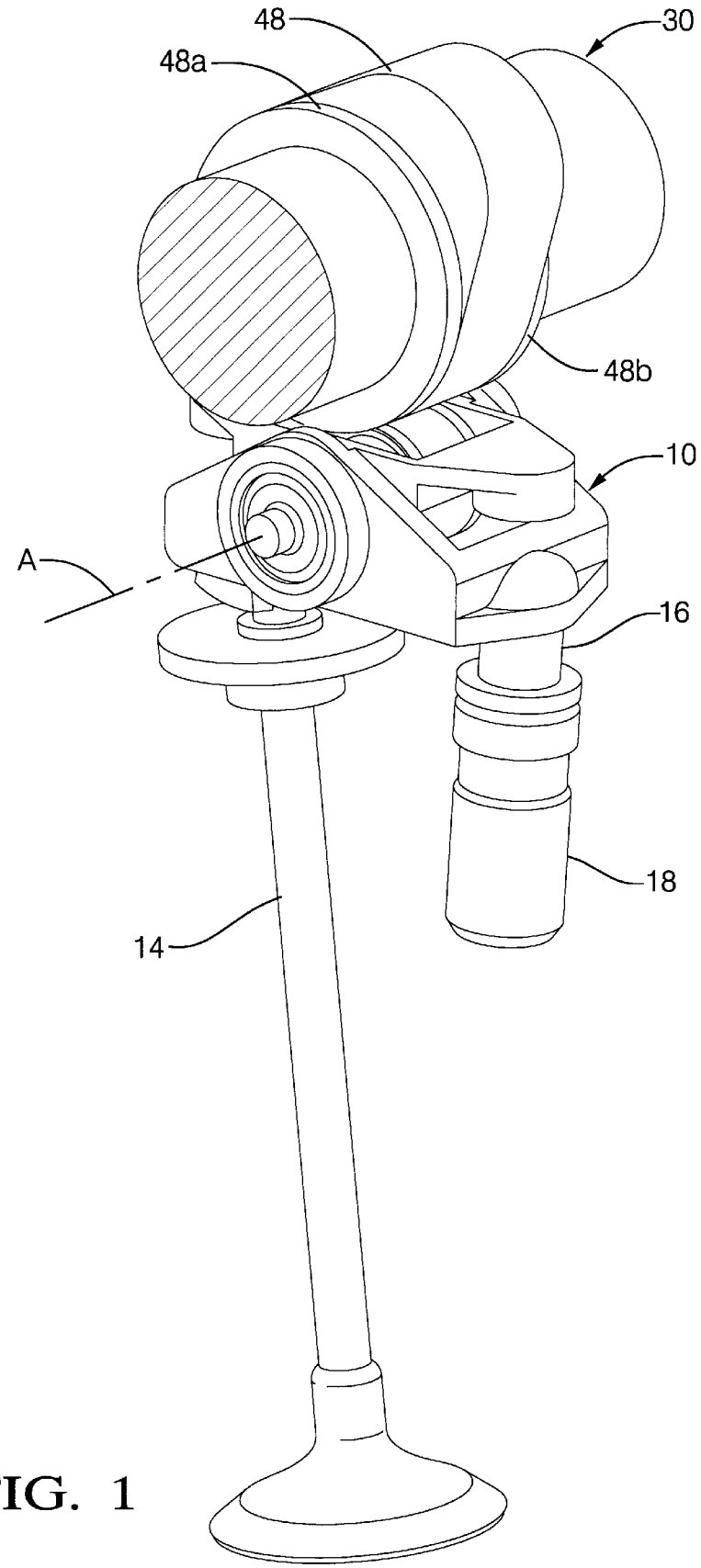
FIG. 1 is an isometric view of one embodiment of a roller finger follower of the present invention operably installed in an engine.

Referring now to the drawings, and particularly to FIG. 1, there is shown one embodiment of a roller finger follower of the present invention. Roller finger follower (RFF) 10 is installed in internal combustion engine 12. A first end of RFF 10 engages valve stem 14 of engine 12, a second end engages a stem 16 of lash adjuster 18.

Figure 2:
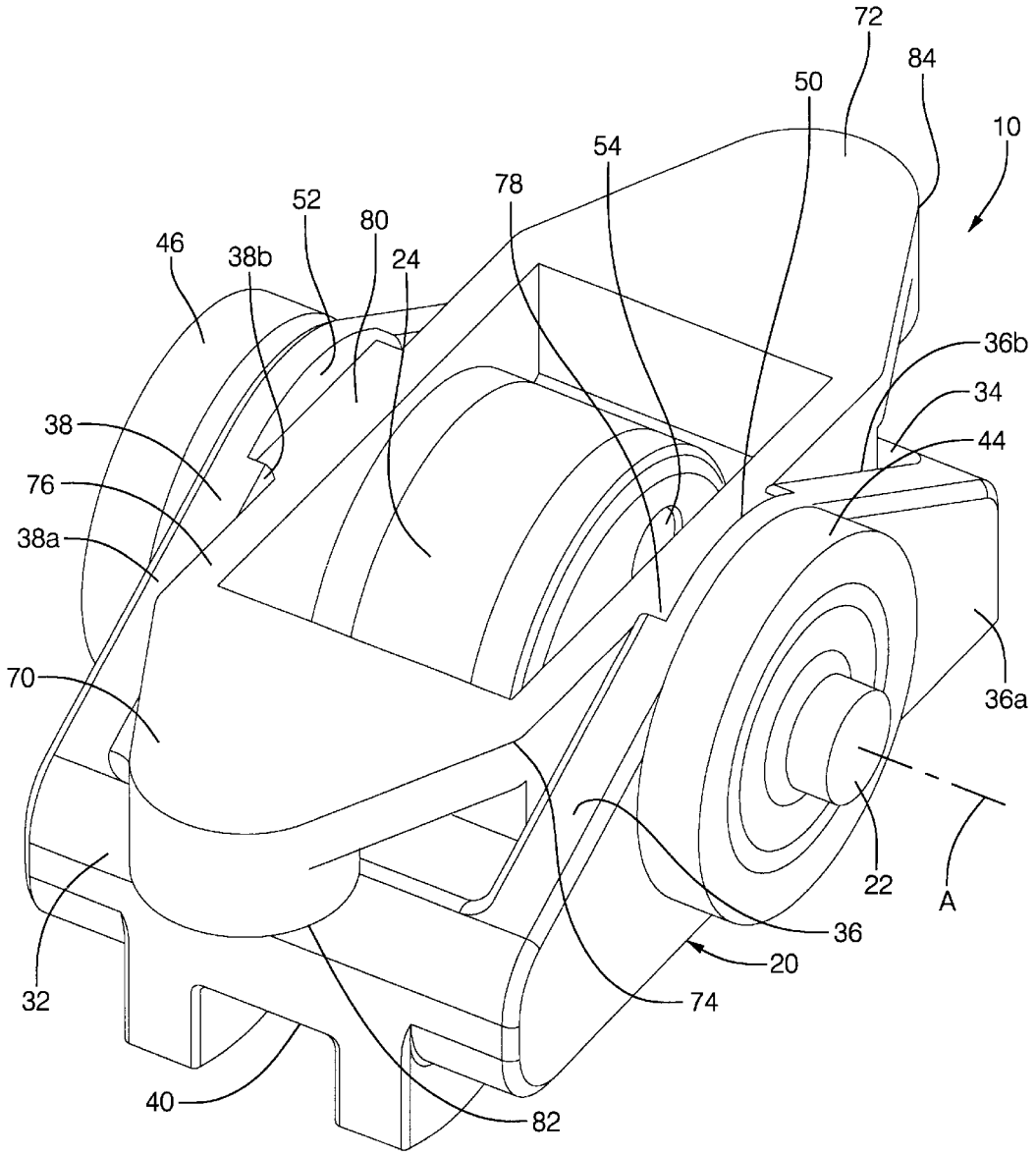
FIG. 2 is an isometric view of the RFF of FIG. 1.

Referring now to FIG. 2, RFF 10 includes body 20, locking pin assembly 22, roller 24, and bracket 26. As will be more particularly described hereinafter, roller 24 engages camshaft 30 of engine 12.

Body 20 includes first end 32, second end 34, elongate first side member 36, and elongate second side member 38. First end 32 includes valve stem seat 40, which receives valve stem 14 of engine 12. Second end 34 defines a semi-spherical lash adjuster socket 42 (not shown), which receives lash adjuster stem 16 of engine 12. Each of first side member 36 and second side member 38 includes a respective outside surface 36*a* and 38*a*.

Outer rollers 44, 46 are rotatably disposed, such as, for example, on bosses or studs (not shown), adjacent outside surfaces 36*a*, 38*a*, respectively. Outer rollers 44, 46 rotate freely about axis A. Referring to FIG. 1, the outer surface (not referenced) of outer roller 44 engages low- or zero-lift cam lobe 48*a* (FIG. 1) and the outer surface (not referenced) of outer roller 46 engages low- or zero-lift cam lobe 48*b* (FIG. 1). Low- or zero-lift cam lobes 48*a*, 48*b* are configured with one of a low lift relative to high-lift cam lobe 48 or substantially zero lift. High-lift cam lobe 48 (FIG. 1) is disposed between cam lobes 48*a*, 48*b* on camshaft 30, and has high lift profile relative to cam lobes 48*a*, 48*b*.

First side member 36 and second side member 38 each include an inside surface 36*b*, 38*b*, respectively. Inside surface 36*b* defines groove 50 and inside surface 38*b* defines groove 52.

Roller 24 is a substantially cylindrical hollow member. Roller 24 is rotatably disposed upon and carried by engages elongate hollow shaft 54. A plurality of needle bearings (not shown) is disposed between an inside surface of roller 24 and an outside surface of shaft 54. Thus, roller 24 is free to rotate about shaft 54 and relative to axis A in an essentially friction free manner. The outer surface (not referenced) of roller 24 is configured to engage high-lift cam lobe 48 of camshaft 30 of internal combustion engine 12. Locking pin assembly 22 extends through shaft 54, and selectively couples and decouples shaft 54 to and from body 20, and is more particularly described in commonly-assigned U.S. patent application Ser. No. 09/664,668, the disclosure of which is incorporated herein by reference.

Figure 3:
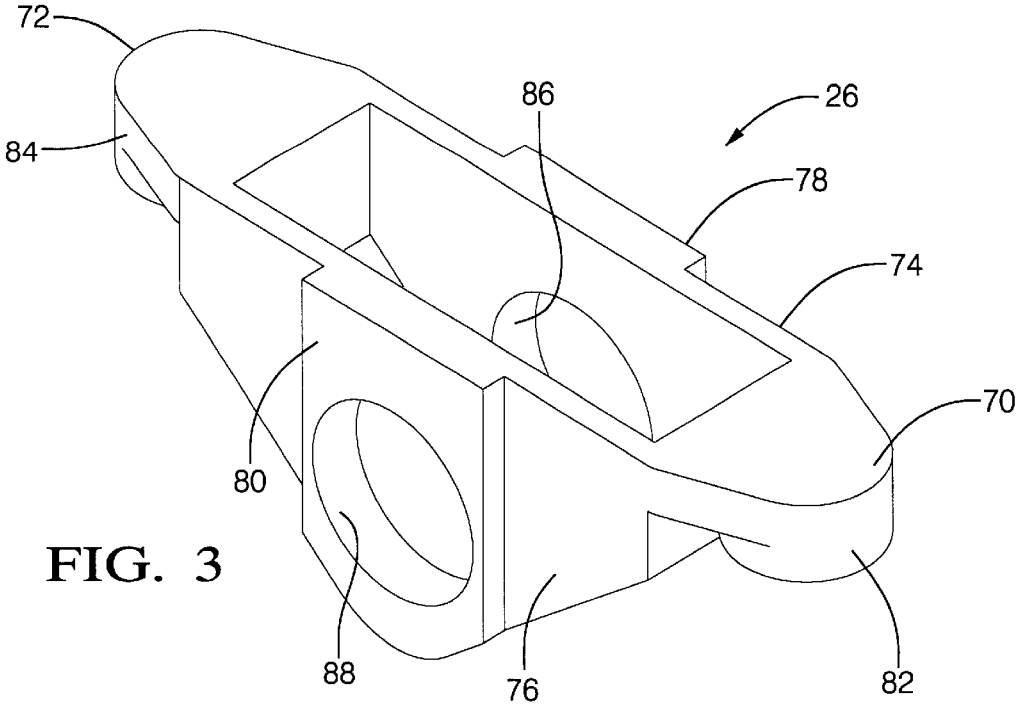
FIG. 3 is an isometric view of the lost motion bracket of FIG. 2.

Bracket 26 includes, as best shown in FIGS. 2 and 3, first bracket end 70, second bracket end 72, first bracket side 74, second bracket side 76, and protrusions 78, 80. Each of first bracket end 70 and second bracket end 72 is somewhat arch-like or parabolic in shape. The bottom surface of first bracket end 70 defines first spring seat 82 and, similarly, the bottom surface of second bracket end 72 defines second spring seat 84.

Each of first bracket side 74 and second bracket side 76 is somewhat arch-like or parabolic in shape, and extends longitudinally between first bracket end 70 and second bracket end 72. The top surfaces (not referenced) of first bracket side 74 and second bracket side 76 are substantially planar with the top surfaces (not referenced) of first bracket end 70 and second bracket end 72. Each of first bracket side 74 and second bracket side 76 defines a respective shaft orifice 86, 88 therethrough. Each of shaft orifices 86, 88, is substantially concentric with center axis A when bracket 26 is positioned in RFF 10 and locking pin assembly 22 is selectively positioned in the default/coupled position. Each of first bracket side 74 and second bracket side 76 further defines a respective protrusion 78, 80.

Each of protrusions 78, 80 extend from a respective top surface (not referenced) of first bracket side 74 and second bracket side 76 to a respective bottom surface of first bracket side 74 and second bracket side 76. Shaft orifice 86 in first bracket side 74 extends through protrusion 78 and shaft orifice 88 in second bracket side 76 extends through protrusion 80. The side and top edges of each of protrusions 78, 80 are substantially straight and each of the top edges of protrusions 78, 80 is substantially planar with a respective top surface (not referenced) of first bracket side 74 and second bracket side 76. The side edges of protrusions 78,80 are substantially perpendicular to the top edge of protrusions 78, 80. The widths of protrusions 78, 80 are specified such that protrusion 78 slidingly engages groove 50 and protrusion 80 slidingly engages groove 52 with relatively close tolerances. The bottom edges of protrusions 78, 80 are somewhat arch-like or parabolic in shape.

Figure 4:
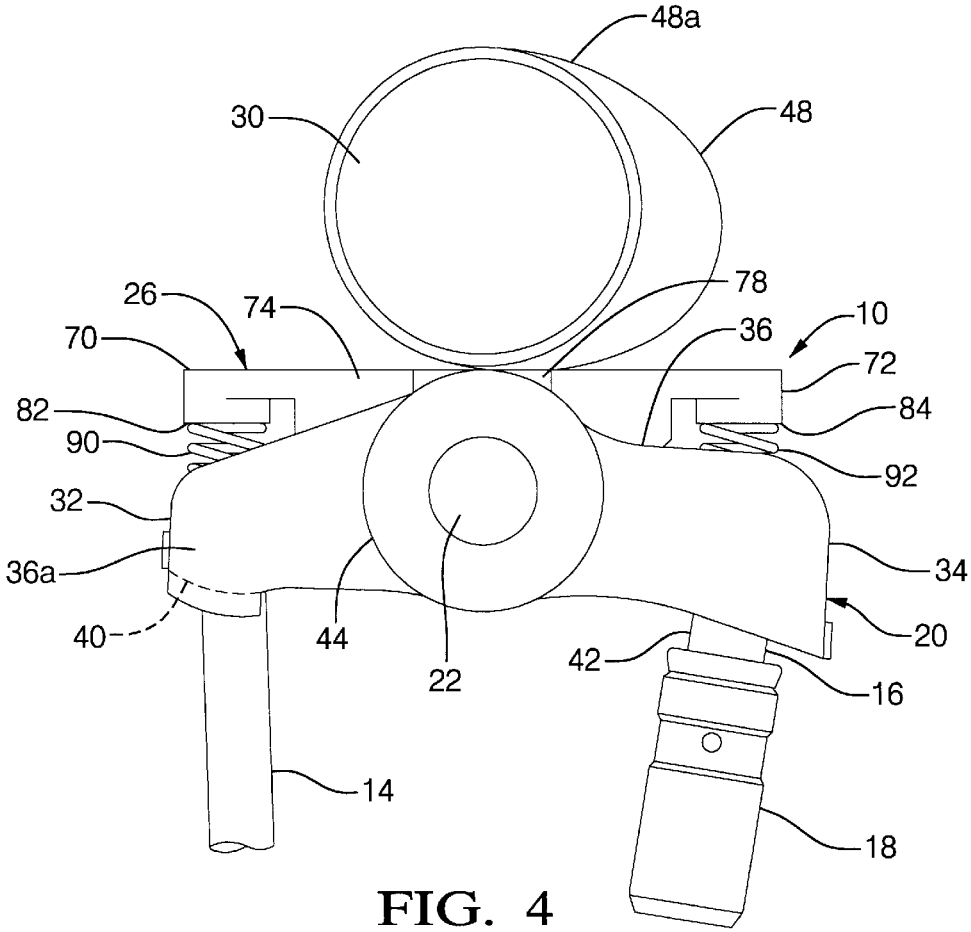
FIG. 4 is a side view of the RFF of FIG. 1.

As best shown in FIGS. 2 and 4, bracket 26 is disposed within body 20. A first end (not referenced) of shaft 54 is disposed within first shaft orifice 86 and a second end of shaft 54 (not shown) is disposed within second shaft orifice 88. Roller 24 is therefore disposed between first bracket side 74 and second bracket side 76. Bracket 26 extends from first end 32 to second end 34 of body 20. First coil spring 90 is disposed at least partially within first coil spring seat 82, and is in abutting engagement with first end 32 of body 20. Similarly, second coil spring 92 is disposed at least partially within second coil spring seat 84, and is in abutting engagement with second end 34 of body 20.

In use, RFF 10 is disposed such that roller 24 engages high-lift cam lobe 48, valve stem seat 40 receives valve stem 14, and lash adjuster socket 42 engages lash adjuster stem 16. Outer rollers 44, 46 each engage a respective low- or zero-lift cam lobes 48*a,* 48*b* of camshaft 30, which prevents any undesirable pump up of lash adjuster 18 due to oil pressure.

In the default or coupled position, as shown in FIG. 3, locking pin assembly 22 couples shaft 54, and thus roller 24, to body 20 to thereby transfer rotary motion of high-lift cam lobe 48 to vertical motion of valve stem 14. More particularly, rotary motion of high-lift cam lobe 48 is transferred by roller 24 to shaft 54 and, in turn, to body 20. The coupling of shaft 54, and thus roller 24, to each of first and second side members 36, 38, respectively, by locking pin assembly 22 transfers the rotary motion of high-lift cam lobe 48 via roller 24 to pivoting movement of body 20 about lash adjuster 18, thereby reciprocating valve stem 14 and actuating a corresponding valve of engine 12. Since shaft 54 is coupled by locking pin assembly 22 to body 20, roller 24 and bracket 26 do not move relative to body 20. Therefore, coil springs 90, 92 are not compressed with locking pin assembly 22 in the default or coupled position. A valve spring (not shown) biases valve stem 14 towards the closed position. Valve stem 14, in turn, biases RFF 10 toward camshaft 30. Therefore, the force due to valve spring 94 maintains the contact between roller 24 and high-lift cam lobe 48.

In the deactivated/decoupled mode, locking pin assembly 22 does not couple shaft 54 to body 20. Thus, shaft 54 and roller 24 are not coupled to either of first side member 36 or second side member 38 of body 20. Thus, rotary motion of high-lift cam lobe 48 is transferred by roller 24 via shaft 54 to bracket 26. Accordingly, shaft 54, roller 24 and bracket 26 are correspondingly reciprocated relative to body 20. More particularly, as high-lift cam lobe 48 engages roller 24, shaft 54 is reciprocated toward and away from camshaft 30. Shaft 54, as described above, carries roller 24, and has a first end (not referenced) disposed within first shaft orifice 86 of bracket 26 and a second end disposed within second shaft orifice 88 of bracket 26. Thus, shaft 54 couples roller 24 to bracket 26. Therefore, reciprocation of shaft 54, in turn, is transferred to reciprocation of bracket 26 toward and away from camshaft 30.

Bracket 26 reciprocates within each of grooves 50 and 52 in a direction toward and away from camshaft 30. In contrast to the default position, rotary motion of high-lift cam lobe 48 is not transferred by roller 24 via shaft 54 and locking pin assembly 22 to pivotal movement of body 20. Therefore, in the case that low- or zero-lift cam lobes 48*a,* 48*b* are zero lift cam lobes, valve stem 14 is not reciprocated nor is a corresponding valve of engine 12 actuated. In the case that low- or zero-lift cam lobes 48*a,* 48*b* are low-lift cam lobes, valve stem 14 is reciprocated a relatively small amount due to the engagement of low-lift cam lobes 48*a,* 48*b* with outer rollers 44, 46, respectively, thereby resulting in pivotal movement of body 20 and actuation of the corresponding engine valve.

As bracket 26 reciprocates, protrusions 78, 80 of bracket 26 reciprocate or slide within each of grooves 50, 52 in a direction toward and away from camshaft 30. As described above, the widths of protrusions 78, 80 are specified such that protrusion 78 slidingly engages groove 50 and protrusion 80 slidingly engages groove 52 with relatively close tolerances. Bracket 26 is substantially precluded from moving in a transverse direction, i.e., in a direction toward and/or away from first end 32 of body 20, by the engagement of protrusions 78, 80 within grooves 50, 52, respectively. Bracket 26 carries shaft 54 which, in turn, carries roller 24. Thus, roller 24 and bracket 26 are also substantially precluded from moving in a transverse direction toward and/or away from first end 32 of body 20. Therefore, play of shaft 54 and roller 24 in a transverse direction is substantially reduced, and generally smoother and more controlled displacement thereof occurs due to the engagement of protrusions 78, 80 of bracket 26 within grooves 50, 52, respectively.

In the deactivated/decoupled state, first coil spring 90 and second coil spring 92 control the motion of bracket 26 toward and away from camshaft 30 and roller 24 toward and away from camshaft 30, and ensure that roller 24 remains in contact with high-lift cam lobe 48. Grooves 50, 52 retain and guide the movement of bracket 26 as high-lift cam lobe 48 rotates and displaces roller 24 and, thus, bracket 26. As stated above, bracket 26 is disposed upon shaft 54 proximate to first and second side members 36, 38 of body 20. First coil spring 90 engages first coil spring seat 82 and the top surface (not referenced) of first end 32 of body 20. Likewise, second coil spring 92 engages second coil spring seat 84 and the top surface (not referenced) of second end 34 of body 20. First and second coil springs 90 and 92 apply a spring force or load upon first and second bracket end 70, 72, respectively, to thereby bias bracket 26 and, thus, roller 24 in the direction towards camshaft 30.

As high-lift cam lobe 48 is rotated from a low-lift to a higher lift profile, a downward force is exerted upon roller 24 and, thus, bracket 26. In the decoupled position, this force is transmitted to first and second coil springs 90, 92 by bracket 26. The force of first and second coil springs 90, 92 upon bracket 26 and, thus, roller 24 is overcome by the force exerted by high-lift cam lobe 48 through roller 24 upon bracket 26, thereby resulting in bracket 26 being slidingly displaced within grooves 50, 52 in a direction away from camshaft 30. The spring constants of first and second coil springs 90, 92 are selected such that the resultant spring force of coil springs 90, 92 on end 32 of body 20 is less than the spring force of the valve spring 94 (not shown) attached to valve stem 14. Thus, when a load on bracket 26 is transmitted through coil springs 90, 92 to body 20, coil springs 90, 92 are compressed, valve spring 94 is not compressed, and valve stem 14 does not translate. Therefore, the downward motion of roller 24 and bracket 26 is absorbed by first and second coil springs 90, 92. As high-lift cam lobe 48 is rotated from a higher lift position to a lower lift position, the load exerted through bracket 26 upon roller 24 by first and second coil springs 90 and 92 maintains roller 24 in contact with high-lift cam lobe 48. As high-lift cam lobe 48 returns to its zero lift profile, first and second coil springs 90, 92 bias bracket 26 within grooves 50, 52 in the direction of camshaft 30 and into a position which enables the return of locking pin assembly 22 to the default position.

Figure 5:
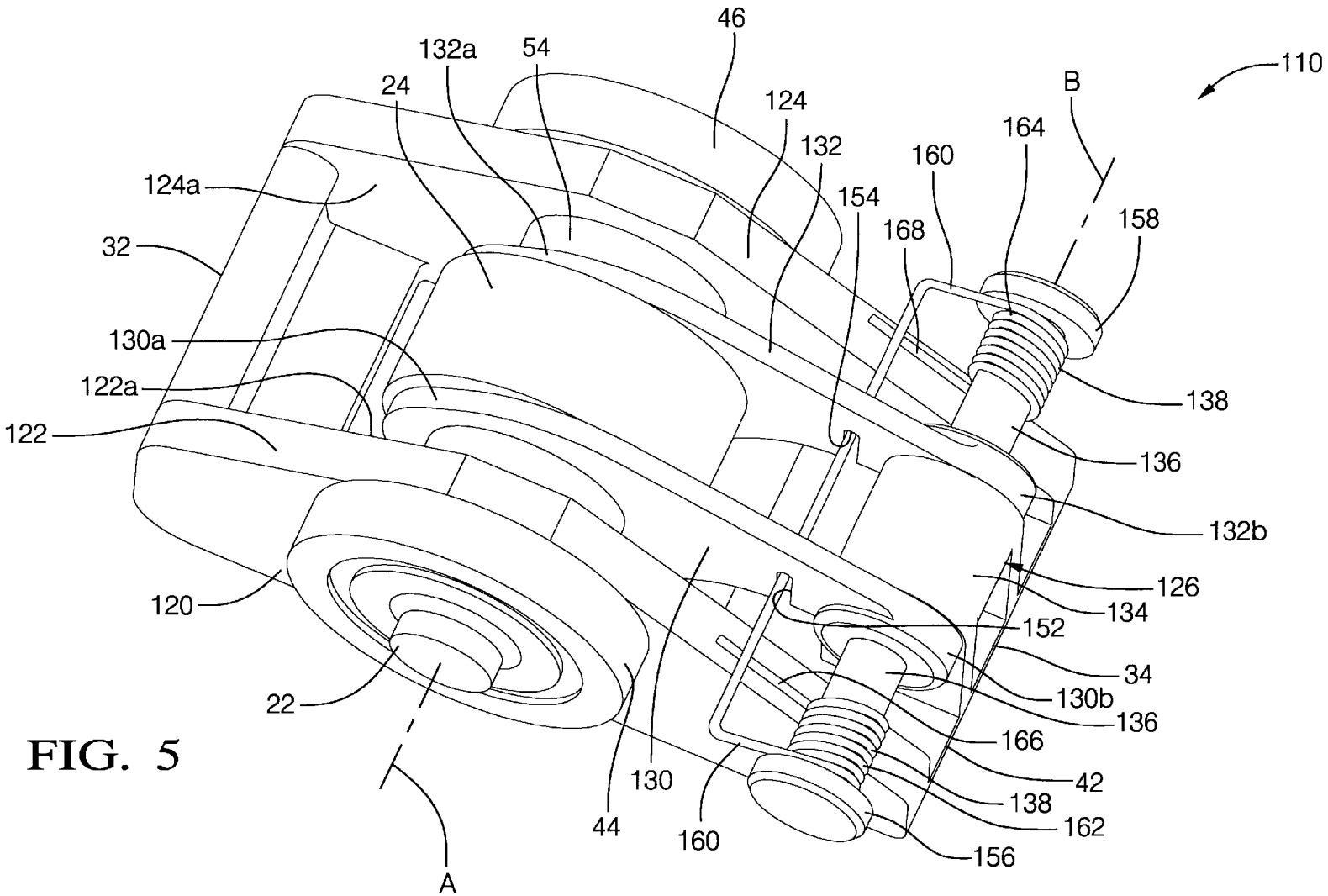
FIG. 5 is an isometric view of a second embodiment of the lost motion bracket of the present invention as installed in a RFF.

Referring now to FIG. 5, a second embodiment of a RFF of the present invention is shown. The same reference numbers are used indicate component parts associated with RFF 110 that are substantially identical in structure and function as those of RFF 10, described above. RFF 110 is installed in internal combustion engine 12. RFF 110 includes body 120, locking pin assembly 22, roller 24, and bracket 126.

Body 120 includes first side 122 with inner surface 122*a* and second side 124 with inner surface 124*a*. First side 122 and second side 124 respectively correspond to first side 36 and second side 38 of body 20. First side 122 and second side 124 respectively differ from first side 36 and second side 38 in that inner surface 122*a* of first side 122 and inner surface 124*a* of second side 124 are substantially flat and do not define grooves such as groove 50 of inner surface 36*b* and groove 52 of inner surface 38*b* of RFF 10.

Bracket 126 includes first arm 130, second arm 132, spacer 134, spring rod 136, and torsion spring 138. Each of first arm 130 and second arm 132 has a respective first arm end 130*a,* 132*a* as well as a respective second arm end 130*b,* 132*b*. Each of first arm 130 and second arm 132 are pivotally coupled to body 120 and in close proximity to a corresponding one of first side 122 and second side 124. More particularly, first arm 130 is disposed in close proximity to inside surface 122*a* of first side 122, and second arm 132 is disposed in close proximity to inside surface 124*a* of second side 124. The cumulative clearance between first arm 130 and inner surface 122*a,* and between second arm 132 and inside surface 124*a,* is a predetermined small distance, such as, for example, between 0.1 to 0.3 millimeters (mm), to allow for lubrication of each respective arm/inner surface interface.

Figure 6:
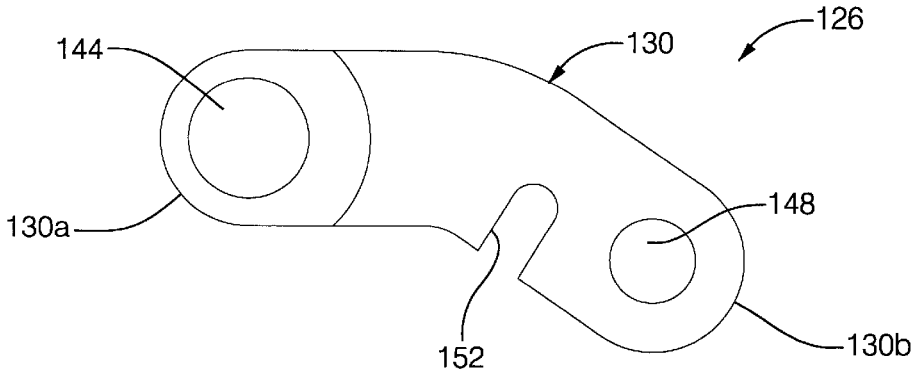
FIG. 6 is a side view of the lost motion bracket of FIG. 5.
Figure 8:
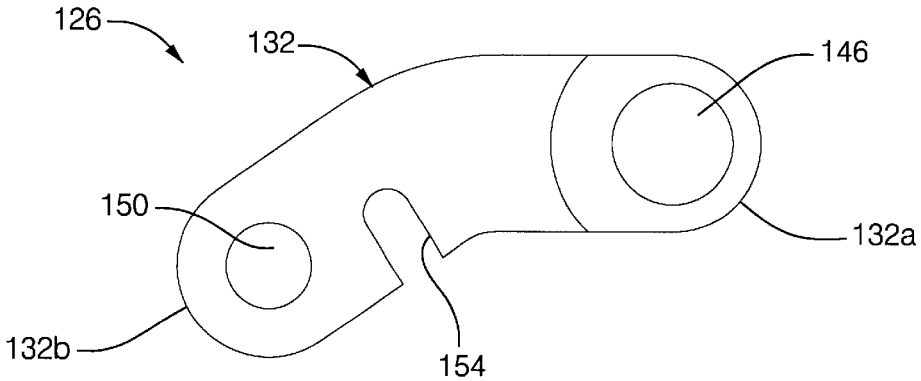
FIG. 8 is an opposite side view of the lost motion bracket of FIG. 5.

As best seen in FIGS. 6 and 8, each of first arm 130 (FIG. 6) and second arm 132 (FIG. 8) are curved in shape. First arm 130 and second arm 132 each define a bend, such as, for example, an angle of approximately 40 degrees, between a respective first end 130*a,* 132*a* and a respective second end 130*b,* 132*b* thereof. First end 130*a* of first arm 130 defines first shaft orifice 144 and first end 132*a* of second arm 132 defines second shaft orifice 146 (not shown). Each of first shaft orifice 144 and second shaft orifice 146 is elongated and/or elliptical in shape. A respective end of shaft 54 is disposed in each of first shaft orifice 144 and second shaft orifice 146. Roller 24 is rotatably disposed upon and carried by shaft 54. Second end 130*b* of first arm 130 defines first spring rod orifice 148 and second end 132*b* of second arm 132 defines second spring rod orifice 150 (not shown). First spring rod orifice 148 and second rod orifice 150 are substantially concentric about axis B. First arm 130 further includes first notch 152 and second arm 132 includes second notch 154 (not shown). First notch 152 is proximate second arm end 130*b* of first arm 130 and second notch 154 is proximate second arm end 132*b* of second arm 132.

Spacer 134 is a hollow cylindrical member interconnecting second arm end 130*b* age of first arm 130 and second arm end 132*b* of second arm 132. Spacer 134 is substantially concentric about axis B.

Spring rod 136 is an elongate cylinder disposed within and extending through spacer 134 into first spring rod orifice 148 and into second spring rod orifice 150. A first end (not referenced) of spring rod 136 defines first shoulder 156 and a second end (not referenced) of spring rod 136 defines second shoulder 158.

Figure 7:
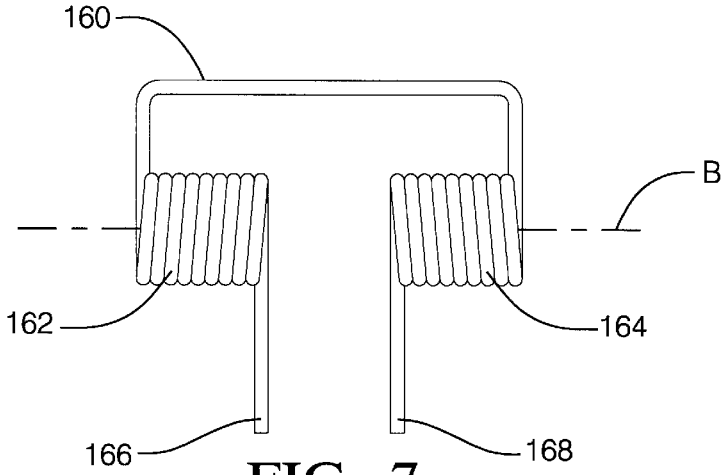
FIG. 7 is a perspective view of the lost motion spring of FIG. 5.

As seen in FIGS. 5 and 7, torsion spring 138 is a double bodied torsion spring and includes spring seating 160, coils 162, 164, and spring arms 166, 168. Spring seating 160 is received within and abuttingly engages a top surface of each of first notch 152 and second notch 154. Spring coil 162 is disposed on spring rod 136 between first shoulder 156 and first arm 130. Spring coil 162 surrounds at least a portion of spring rod 136 between first shoulder 156 and first arm 130. Spring arm 166 is in abutting engagement with the top surface (not referenced) of first side member 122 of body 120. Similarly, spring coil 164 is disposed on spring rod 136 between second shoulder 158 and second arm 132. Spring coil 164 surrounds at least a portion of spring rod 136 between second shoulder 158 and second arm 132. Spring arm 168 is in abutting engagement with the top surface (not referenced) of second side member 124 of body 120.

In use, RFF 110 works in generally the same manner as RFF 10, and bracket 126 performs the same general function as described above in regard to bracket 26, i.e., limiting movement of roller 24 and shaft 54 in a direction transverse to body 120 to improve switching reliability. However, bracket 126 performs this function by pivoting rather than reciprocating as does bracket 26.

In the default or coupled state, RFF 110 and RFF 10 works in a substantially similar manner to a conventional RFF. In the deactivated/decoupled state, locking pin assembly 22 is selectively switched to the decoupled position such that shaft 54, and thus roller 24, are no longer coupled to body 120. In general, rotation of high-lift cam lobe 48 to a higher lift position causes bracket 126 to pivot about axis B of spring rod 136 in a direction away from camshaft 30. More particularly, as high-lift cam lobe 48 rotates to a higher lift position, high-lift cam lobe 48 places a force on roller 24 and, thus, shaft 54 in the direction away from camshaft 30. Shaft 54 and, thus, roller 24 translate within elongated shaft orifices 144, 146 as a result of the force applied by cam lobe 48. The translatory movement of shaft 54 within shaft orifices 144, 146 and of roller 24 carried by shaft 54 is transferred to a pivoting of bracket 126 about axis B of spring rod 136. As bracket 126 pivots, the elongation of shaft orifices 144, 146 permit shaft 54 to translate with roller 24.

Torsion spring 138 applies a load to body 120 as bracket 126 pivots away from cam shaft 30. The spring constant of torsion spring 138 is specified such that the load applied to first side 122 and second side 124 of body 120 is smaller than the load that would be required to create a moment about end 34 of body 120 large enough to cause the leak down of lash adjuster 18. Therefore, in the deactivated/decoupled mode, body 120 does not pivot and RFF 110 is maintained in contact with the associated valve.

As high-lift cam lobe 48 rotates or pivots toward a lower lift position, torsion spring 138 maintains contact between roller 24 and high-lift cam lobe 48. More particularly, as high-lift cam lobe 48 rotates or pivots toward a lower lift position, spring seating 160 of torsion spring 138 applies a load to first arm 130 and second arm 132 which, in turn, pivots bracket 126 about spring rod 136 and toward camshaft 30. Thus, torsion spring 138 biases bracket 126 in a direction towards camshaft 30, thereby maintaining roller 24 in contact with high-lift cam lobe 26.

It should be particularly noted that in both the embodiments shown, roller 24 is disposed within bracket 26 or bracket 126. Thus, needle bearings that are disposed between roller 24 and shaft 52 are retained within roller 24 by bracket 26 in the first embodiment. The needle bearings are thereby protected from damage. The elongation of shaft orifices 144, 146 in the second embodiment are small for two-step applications, and bracket 126 retains the needle bearings.

In the first embodiment shown, side members 36, 38 of RFF 10 each define grooves 50, 52, respectively, within which are received protrusions 78, 80 of bracket 26. However, it is to be understood that RFF 10 and bracket 26 can be alternately configured, such as, for example, as fitting together with relatively tight tolerances to thereby substantially reduce any play in the shaft in a direction generally transverse to the body of the RFF.

In the second embodiment shown, torsion spring 138 is a double bodied torsion spring. However, it is to be understood that RFF 110 can be alternately configured, such as, for example, with two single bodied torsion springs.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed is:

1. A roller finger follower, comprising:

an elongate body having a first side member and a second side member, a first end and a second end interconnecting and spacing apart said first and second side member;

a bracket having first and second sides, said first side being disposed adjacent an inside surface of said first side member, said second side being disposed adjacent an inside surface of said second side member;

a roller disposed between said first and second sides of said bracket, said roller defining a shaft orifice therethrough;

an elongate hollow shaft extending through said shaft orifice, said shaft having a first shaft end and a second shaft end, said first shaft end associated with said first bracket side, said second shaft end associated with said second bracket side, said shaft coupling said roller to said bracket; and a locking pin assembly disposed at least partially within said hollow shaft, said locking pin assembly having a first position wherein said shaft is decoupled from said body and a second position wherein said shaft is coupled to said body, said locking pin assembly being axially switchable along its axis (A) between said first position and said second position.

2. The roller finger follower of claim 1, further comprising a first projection disposed on an outside surface of said first side of said bracket, a second projection disposed on an outside surface of said second side of said bracket.

3. The roller finger follower of claim 2, wherein each of said first projection and said second projection are configured for limiting movement of said bracket in a direction that is generally transverse relative to said body.

4. The roller finger follower of claim 2, further comprising a first groove defined by said inside surface of said first side member, a second groove defined by said inside surface of said second side member, said first and second projections slidingly received within a corresponding one of said first and second grooves.

5. The roller finger follower of claim 1, wherein said first side of said bracket defines a first shaft orifice therethrough, said second side of said bracket defines a second shaft orifice therethrough, said first shaft orifice and said second shaft orifice being substantially concentric relative to each other, said first shaft end being received within said first shaft orifice, said second shaft end being received within said second shaft orifice.

6. The roller finger follower of claim 5, wherein said first and second shaft orifices are substantially circular in shape.

7. The roller finger follower of claim 5, wherein said first and second shaft orifices are generally elongated and elliptical in shape.

8. The roller finger follower of claim 7, wherein said first and second sides of said bracket each define a bend therein such that respective opposite ends of each said first and said second side are disposed substantially in parallel with and at a predetermined angle relative to each other.

9. The roller finger follower of claim 7, further comprising a first spring rod orifice defined by said first side of said bracket, a second spring rod orifice defined by said second side of said bracket, a spring rod disposed at least partially within and extending between each of said first and second spring rod orifices.

10. The roller finger follower of claim 9, further comprising a lost motion spring, said lost motion spring engaging said spring rod, each of said first and second side members of said body, and each of said first and second sides of said bracket.

11. The roller finger follower of claim 10, wherein said lost motion spring comprises a double bodied torsion spring having two coils, two spring arms, and a spring seating.

12. The roller finger follower of claim 11, further comprising a notch defined by each of said first and said second side members, each said notch receiving said spring seating.

13. The roller finger follower of claim 1, further comprising a first lost motion spring and a second lost motion spring, said first lost motion spring disposed between and abuttingly engaging a top surface of said first end of said body and a bottom surface of a first end of said bracket, said second lost motion spring disposed between and abuttingly engaging a top surface of said second end of said body and a bottom surface of a second end of said bracket.

14. The roller finger follower of claim 1, further comprising:

a first outer roller rotatably associated with an outside surface of said first side member of said body; and a second outer roller rotatably associated with an outside surface of said second side member of said body.

15. The roller finger follower of claim 14, wherein said first outer roller and said second outer roller are each rotatably affixed to a respective one of said first side member and said second side member.

16. An internal combustion engine, comprising:

a camshaft; and a roller finger follower, including:

an elongate body having a first side member and a second side member, a first end and a second end interconnecting and spacing apart said first and second side member;

a bracket having first and second sides, said first side being disposed adjacent an inside surface of said first side member, said second side being disposed adjacent an inside surface of said second side member;

a roller disposed between said first and second sides of said bracket, said roller defining a shaft orifice therethrough;

an elongate hollow shaft extending through said shaft orifice, said shaft having a first shaft end and a second shaft end, said first shaft end associated with said first bracket side, said second shaft end associated with said second bracket side, said shaft coupling said roller to said bracket; and a locking pin assembly disposed at least partially within said hollow shaft, said locking pin assembly having a first position wherein said shaft is decoupled from said body and a second position wherein said shaft is coupled to said body, said locking pin assembly being axially switchable along its axis (A) between said first position and said second position.

17. The internal combustion engine of claim 16, further comprising:

a center cam lobe and at least one outside cam lobe carried by said camshaft, said center cam lobe engaging said center roller; and at least one outer roller rotatably secured to said body, each of said at least one outside cam lobe engaging a respective one of said at least one outer roller.

18. The internal combustion engine of claim 17, wherein said center cam lobe comprises a high-lift cam lobe, said at least one outside cam lobe comprises two low-lift cam lobes disposed on respective sides of and adjacent to said high-lift cam lobe, said at least one outer roller comprises a first outer roller and a second outer roller, each of said first and said second outer rollers engaging a respective one of said two low-lift cam lobes.

19. The internal combustion engine of claim 17, wherein each of said at least one outer roller is rotatably affixed to a respective one of said first side member and said second side member.

* * * * *